US005829377A

United States Patent [19]

Hoppenhaus

[11] Patent Number: 5,829,377

[45] Date of Patent: Nov. 3, 1998

[54] CLEAT

[76] Inventor: Axel Hoppenhaus, Steckelhörn 12, D-20457 Hamburg, Germany

[21] Appl. No.: 807,793

[22] Filed: Feb. 28, 1997

[30] Foreign Application Priority Data

Mar. 2, 1996 [DE] Germany ..... 296 03 883 U

[51] Int. Cl.[6] ..... B63B 21/04

[52] U.S. Cl. ..... 114/218; D8/382

[58] Field of Search ..... 114/218; D8/382, D8/383, 356

[56] References Cited

U.S. PATENT DOCUMENTS 2,555,805 6/1951 Miller ..... 114/218

FOREIGN PATENT DOCUMENTS 2687120A 8/1993 France ..... 114/218

72710C 6/1993 Germany ..... 114/218

29603883 7/1996 Germany ..... 114/218

1329015 9/1973 United Kingdom ..... 114/218

*Primary Examiner*—Jesus D. Sotelo

*Attorney, Agent, or Firm*—Jacox, Meckstroth & Jenkins

[57] ABSTRACT

The invention relates to a cleat for sailboats, motorboats and sailing yachts. The cleat comprises a base plate on which two cleat arms are arranged pivotably mounted. The end sections, facing one another, of the cleat arms, are engaged with one another via a connecting device for the synchronous operation of the cleat arms. The cleat arms can be locked in an upper end position and a lower end position, wherein the cleat arms are arranged in the operational position in the upper end position and in the lower end position are folded down.

19 Claims, 6 Drawing Sheets

CLEAT

BACKGROUND OF THE INVENTION

This invention relates to a cleat for sailboats, motorboats and sailing yachts.

Cleats serve for fastening spring ropes or fender ropes and are so designed that they comprise at least a foot and at least a cleat arm laterally projecting over the foot. These cleats have the disadvantage that the protruding cleat arms form stumbling steps on which the boat passengers may injure themselves. Moreover, the ropes necessary for the operation of the sails on board a sailboat or sailing yacht may become unintentionally fastened to the cleats and in this way put into question the smooth running and safety of the sailing operation. In order to eliminate this disadvantage, there have already been proposed cleats which can be sunk into the deck. These may be moved out of the cleat housing which is sunk into the deck by applying an operating member. The disadvantage of these cleats lies in the fact that a flawless dewatering of the cleat housing requires extremely time consuming measures when the installation of the cleat is to be effected subsequently. Moreover, there is the danger of mechanical breakdowns, the repair of which is quite difficult.

BRIEF SUMMARY OF THE INVENTION

It is the object of the invention to provide a cleat for sailboats and motorboats, which in the idle condition can be brought into an attitude preventing the danger of injury but for operation can easily be brought into the operational attitude, which in the idle attitude prevents the effective engagement of rope and which comprises only abrasion-poor components as well as requiring no particular additional measures for dewatering.

According to the invention this object is achieved by those features specified in the characterizing part of claim 1. Advantageous forms of the invention are described in the dependent claims.

The cleat according to the invention comprises two cleat arms which are pivotably mounted on a base plate and which can locked into two end positions by way of a connecting device. The one end position forms the operational attitude in which the cleat arms are folded up. In the other end position the cleat arms are in the resting position and lie on the base plate or on the deck. With a curved design of the surface of the base plate in the region of the links, it is prevented that water may collect here. Additionally, the lower surface of the base plate may be curved upwardly in the region of the links in order to let out water entering the base plate and the deck. In the base plate in the region of the links, it is also possible to design an opening which serves for draining water entering into the cleats above the base plate between the cleat arms.

BRIEF DESCRIPTION OF THE SEVERAL VIEWS OF THE DRAWING

The invention is hereinafter described in more detail by way of the embodiment examples of the cleat according to the invention shown in the drawings. These show.

DETAILED DESCRIPTION OF THE INVENTION

Figure 3:
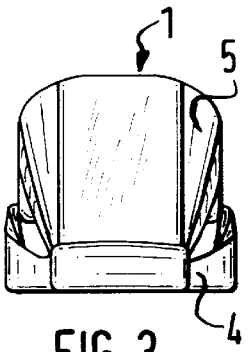
FIG. 3 is a transverse view of the cleat shown in FIG. 1.
Figure 1:
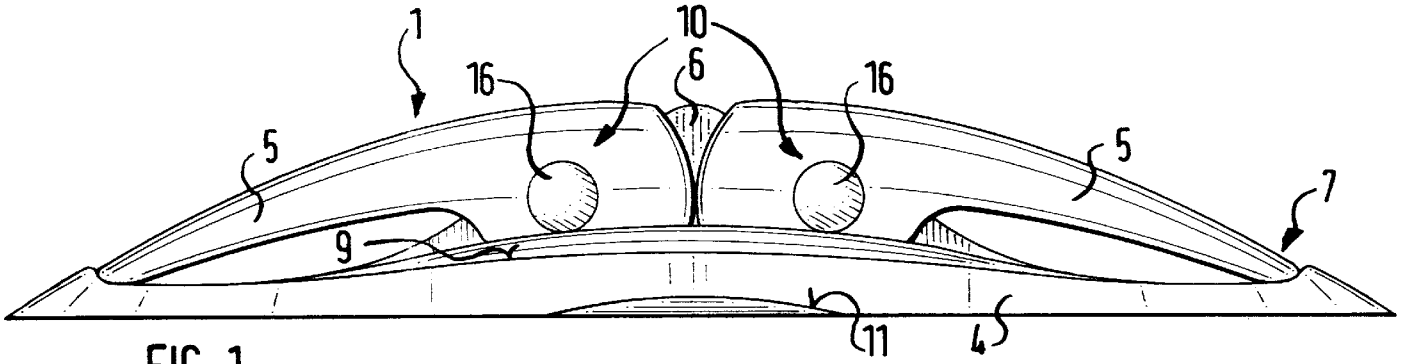
FIG. 1 is a lateral view of a cleat in accordance with one embodiment of the invention.
Figure 2:
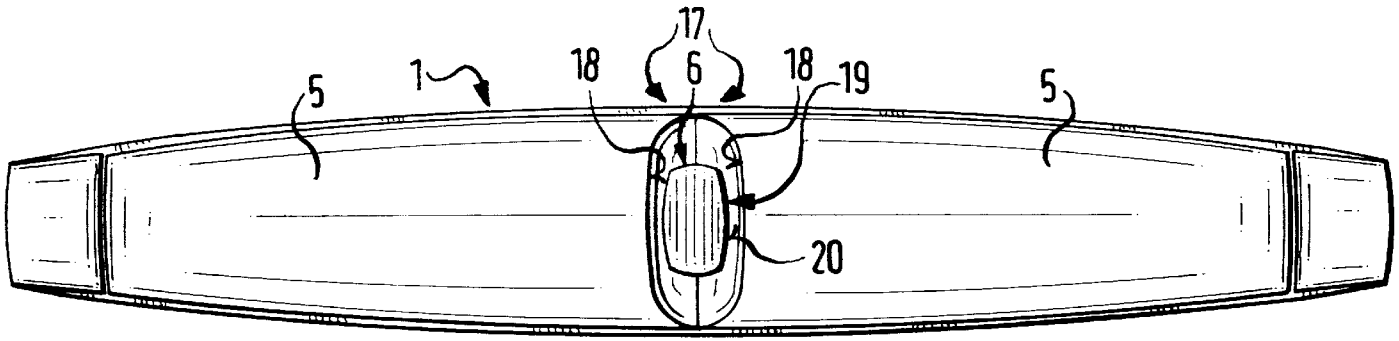
FIG. 2 is a plan view of the cleat shown in FIG. 1.
Figure 6:
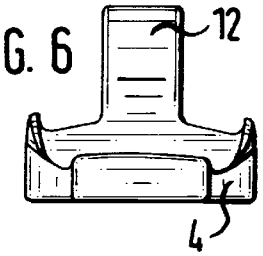
FIG. 6 is a transverse view of the base plate shown in FIG. 4.
Figure 4:
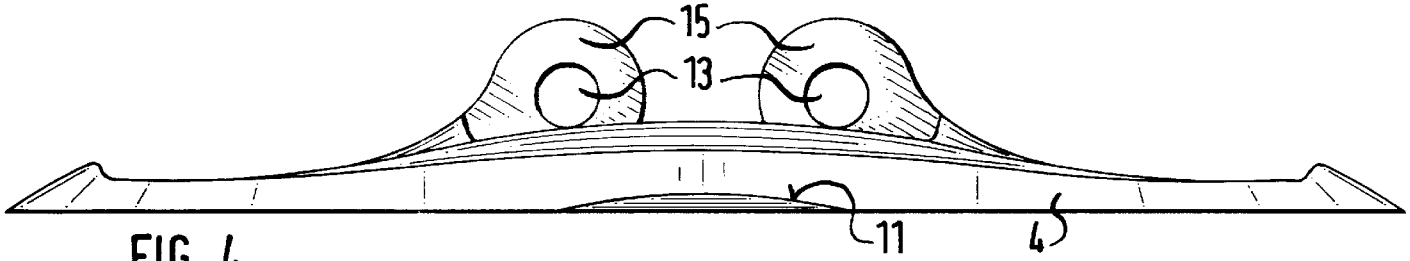
FIG. 4 is a lateral view of a base plate of the cleat shown in FIG. 1.
Figure 5:
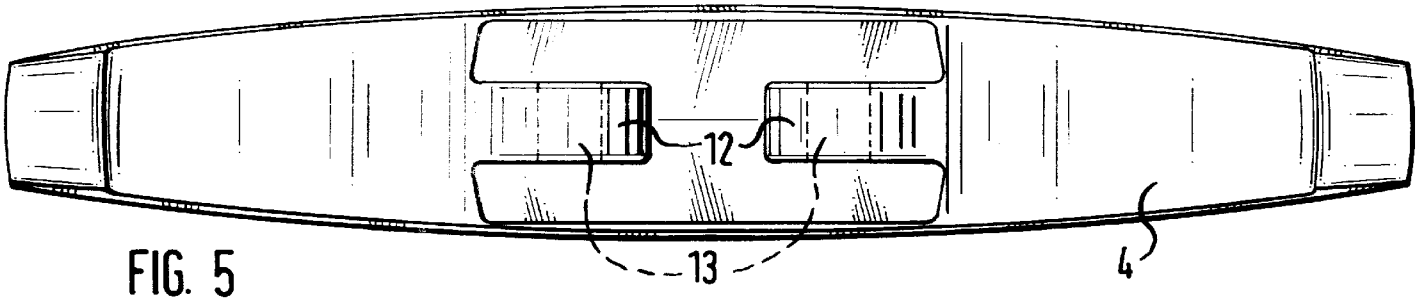
FIG. 5 is a plan view of the base plate shown in FIG. 4.
Figure 8:
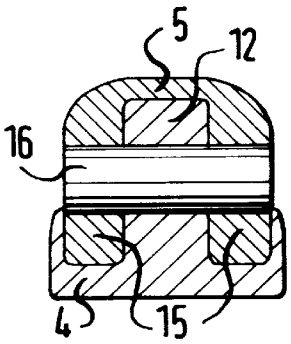
FIG. 8 is a transverse view of the clamping member shown in FIG. 7.
Figure 7:
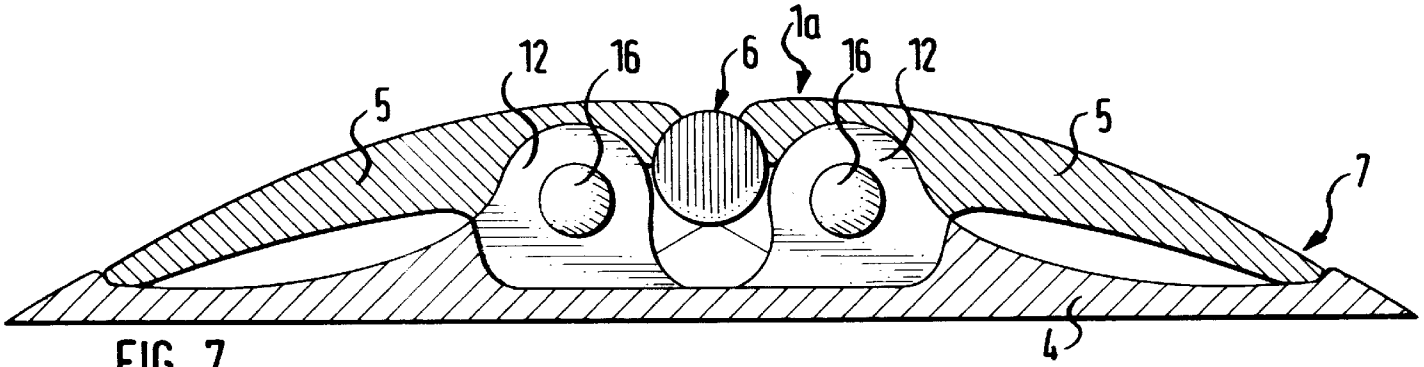
FIG. 7 is another lateral view of the embodiment shown in FIG. 1, showing ball-shaped clamping member.
Figure 9:
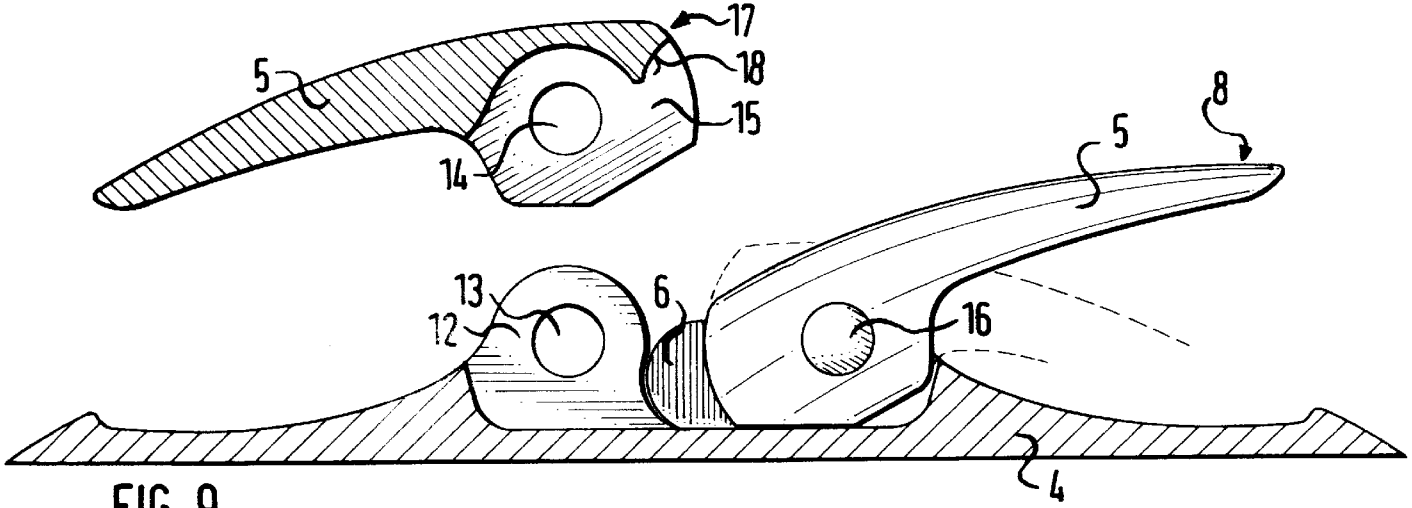
FIG. 9 is an exploded view of the clamping member shown in FIG. 7.
Figure 12:
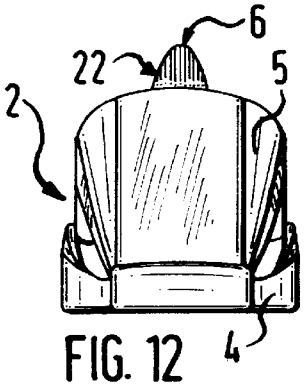
FIG. 12 is a transverse view of the cleat shown in FIG. 10.
Figure 10:
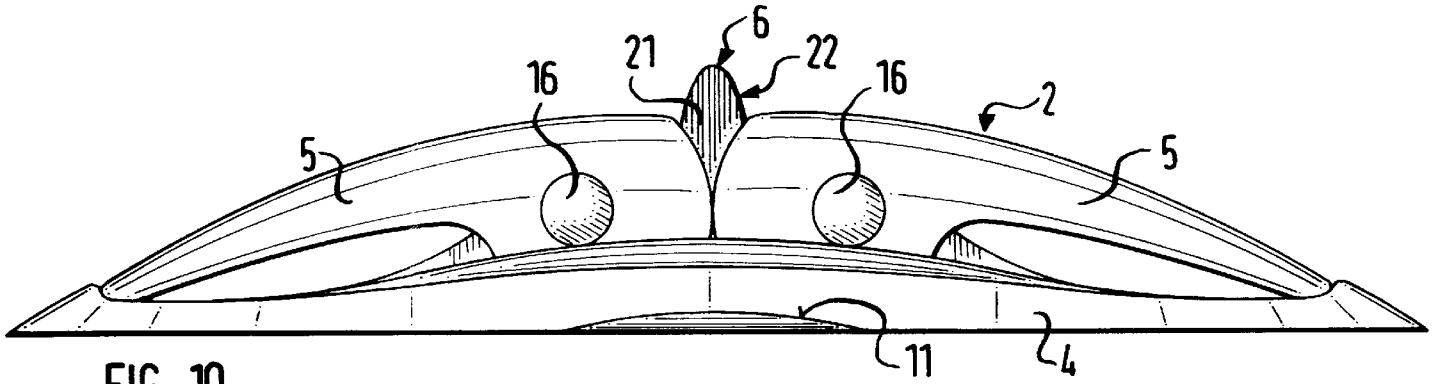
FIG. 10 is a lateral view of a cleat.
Figure 11:
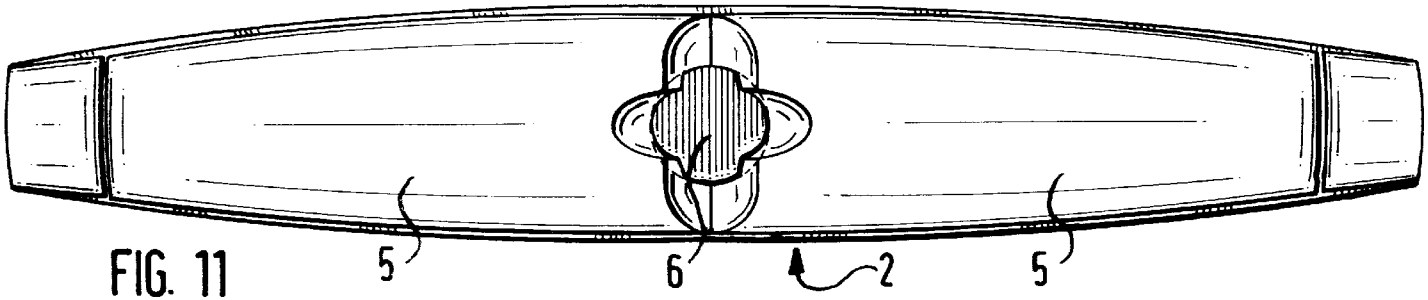
FIG. 11 is a plan view of the cleat shown in FIG. 10.

The cleat 1, 2, 3, is composed of a base plate 4 on which two cleat arms 5 are pivotably mounted and lockable in an upper end position 8 and a lower end position 7 by way of an elastic clamping member 6, whereby the cleat arms 5 in the upper end position 8 are arranged in the operational attitude and in the lower end position 7 lie on the base plate 4. The upper side 9 of the base plate 4 is curved in a crowned manner in the region of the links 10 of the cleat arms 5. The lower side 11 of the base plate 4 is likewise curved in a crowned manner in the region of the links 10.

Two middle webs 12 facing each other and each with an opening 13 are formed on the base plate 4. The cleat arms 5 comprise two parallely arranged lateral flanges 15 at a distance from one another, likewise each with an opening 14. A link bolt 16 is guided through the openings 13 and in each case pivotally mounts a cleat arm 5 onto a middle web 12 of the base plate 4.

Figure 15:
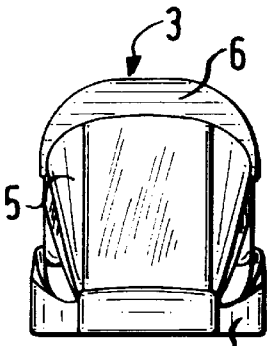
FIG. 15 is a transverse view of the cleat shown in FIG. 13.
Figure 13:
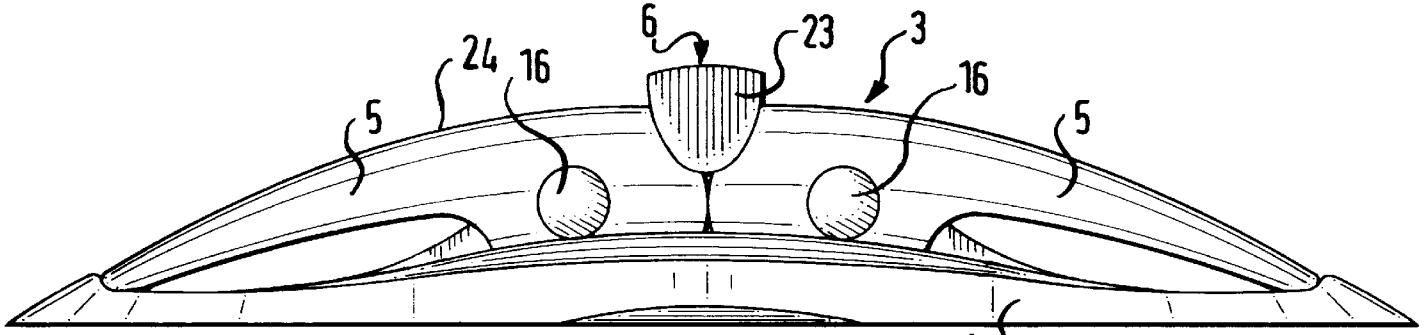
FIG. 13 is a lateral view of another embodiment of a cleat.
Figure 14:
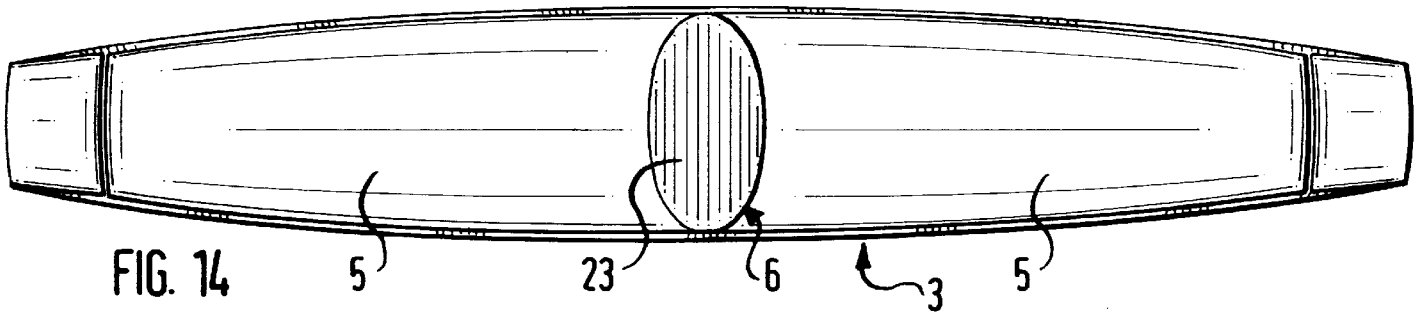
FIG. 14 is a plan view of the cleat shown in FIG. 13.

In each case, a recess 18 is designed on the end sections 17, facing one another, of the cleat arms 5. Between these recesses there is arranged an elastic clamping member 6. The cleat 1 comprises a clamping member 6 which is formed as an elongate body 19 with a crowned lateral surface 20. The cleat 1*a* comprises a ball as an elastic clamping member 6. With the cleat 2, the clamping member 6 is formed as a generally perpendicularly arranged egg-shaped body 21, with which, in the idle position of the cleat arms 5, a section 22 of the body 21 projects over the surface of the cleat arm 5. In order to bring the cleat arms 5 in their operational position, it is only necessary to bring pressure on the projecting section 22 for example by using a foot, whereupon the cleat arms 5 fold upwards. It is possible design the lower located section between the cleat arms 5 ball-shaped as a clamping member 6. The cleat 3 represented in FIGS. 13 to 15 comprises a further clamping member 6 which is formed as a generally horizontally arranged egg-shaped body 23. With this body 23, in the idle position of the cleat arms 5, a flattened body section 24 projects over the surface of the cleat arms 5. This body 23 is led up to the plane of the lateral surface of the cleat arms 5. With this clamping member 6, it is likewise possible to form that section of the clamping member 6 which is located between the cleat arms 6 ball-shaped. The described elastic clamping members 6 may be formed for example of rubber and additionally serve to dampen the noise on opening the cleats 1, 2, and 3. On lifting the cleat arms 5, the elastic clamping members 6 come to rest on the stop surfaces of the lateral flange 15 on the base plate 4, so that on locking, only a muffled sound occurs. This is particularly advantageous when members of the crew or guests are sleeping below deck.

Figure 16:
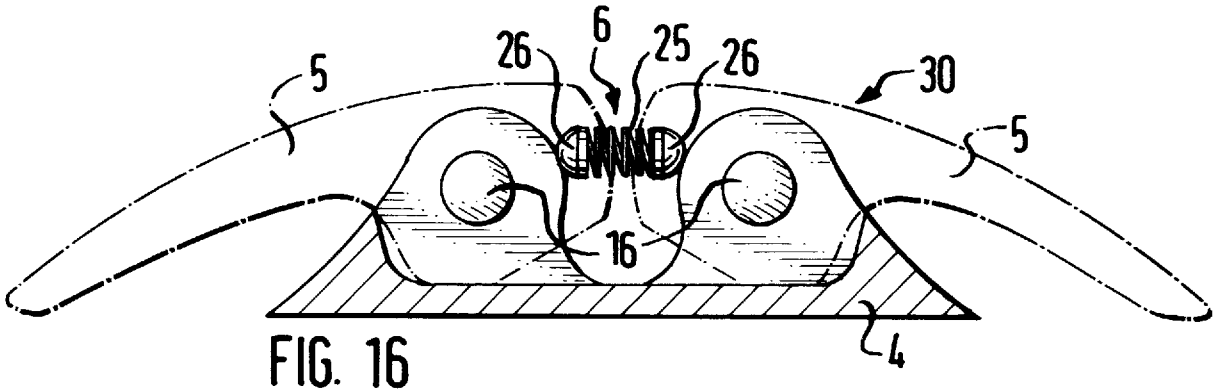
FIG. 16 is a lateral view of another embodiment of the cleat, showing a compressed spring shown therein.

With that cleat 30 represented by way of FIG. 16, the elastic clamping member 6 is designed as a compression spring 25 the end section of which comprising shell-shaped spring plates 26. The spring plates 26 in each case are mounted in a recess 18 of the end section 17 of the cleat arm 5. With this cleat 30, the base plate 4 is formed shortened such that the cleat arms 5 project over it.

Figure 17:
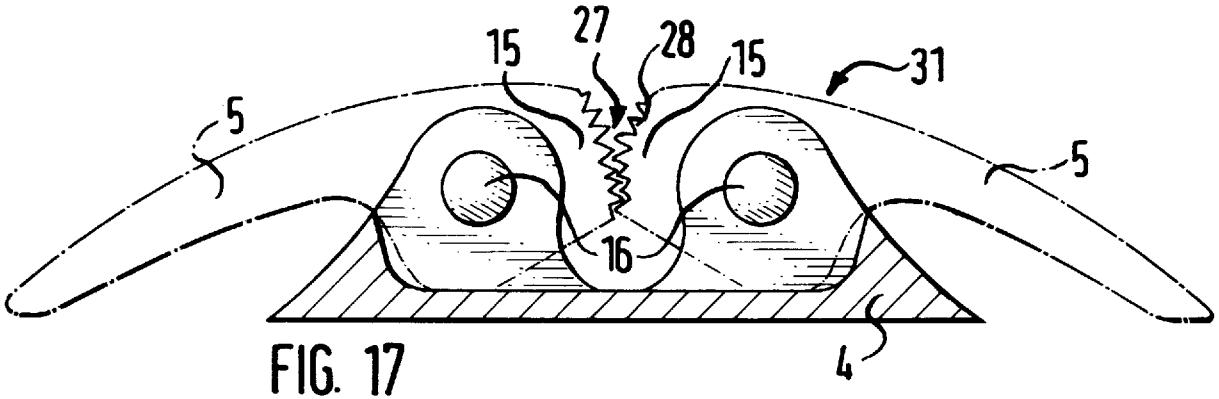
FIG. 17 is a lateral view of another embodiment of the cleat, showing cleat arms having toothed-shaped sections.

FIG. 17 shows a cleat 13, in which the connecting device arranged between the cleat arms is composed of rigidly formed connecting means which are mechanically engaged with one another. Each rigidly formed connecting means is arranged on the end section 17 of the cleat arm 5 and comprises a toothed section 27. The toothed sections 27 are formed on those surface sections, facing one another on the end face sides, of the lateral flange 15 of the cleat arms 5, and are so aligned that the teeth 28 and teeth recesses facing one another are rigidly engaged with one another. Also with this cleat 31, the base plate 4 is so formed that the cleat arms 5 project over it.

I claim:

1. A cleat for sailboats, motorboats and sailing yachts, characterized by a base plate on which two cleat arms are arranged pivotably mounted, of which end sections of said cleat arms face one another and engage an elastic clamping member for the synchronous operation of the cleat arms, wherein said elastic clamping member causes said cleat arms to become locked when said arms are in either an open position or a closed position.

2. The cleat according to claim 1, characterized in that the base plate is generally formed rectangular-shaped in cross section.

3. The cleat according to claim 1, characterized in that the connecting device is composed of connecting means which are rigidly formed on the cleat arms and which are mechanically engaged with one another.

4. The cleat according to claim 3, characterized in that the each rigidly formed connecting means is composed of a toothed section arranged at the end section of the cleat arm.

5. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that the cleat arms lie on the base plate in the lower end position.

6. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that the upper side of the base plate is curved in a crowned manner in the region of the links of the cleat arms.

7. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that the lower side of the base plate is curved in a crowned manner in the region of the links.

8. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that two middle webs facing each other and each with an opening, are formed on the base plate and onto which the cleat arms each with a cleat arm opening are linkably mounted by way of, in each case, a link bolt guided through the openings of said middle webs and said cleat arm openings and the openings of the cleat arms.

9. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that the connecting device is formed as an elastic clamping member.

10. The cleat according to claim 9, characterized in that a recess is formed on the end sections, facing one another, of the cleat arms and between said recesses there is arranged the elastic clamping member.

11. The cleat according to claim 9, characterized in that the elastic clamping member is formed as a ball.

12. The cleat according to claim 9, characterized in that the elastic clamping member is formed as an elongate body with a crowned lateral surface.

13. The cleat according to claim 9, characterized in that the elastic clamping member is formed as a generally perpendicularly arranged egg-shaped body having a section projecting over the surface of the cleat arms when in their idle position.

14. The cleat according to claim 13, characterized in that the section of the egg-shaped body located between the cleat arms is formed ball-shaped.

15. The cleat according to claim 9, characterized in that the elastic clamping member is formed as a generally horizontally arranged egg-shaped body having a flattened body section projecting over the surface of the cleat arms when in their idle position.

16. The cleat according to claim 15, characterized in that the body is led up to the plane of the lateral surfaces of the cleat arm.

17. The cleat according to claim 9, characterized in that the elastic clamping member is formed as a compression spring, the end sections of which comprising shell-shaped spring plates which are mounted in the recesses of the end sections of the cleat arms.

18. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein the cleat arms in the upper end position are open and in the lower end position are folded down;

characterized in that the toothed section is formed on the surface sections facing one another on the end face sides, of the lateral flange of the cleat arms.

19. A cleat for sailboats, motorboats and sailing yachts, characterized by a base plate on which two cleat arms are arranged pivotably mounted, of which end sections of said cleat arms face one another are engaged with one another via a connecting device for the synchronous operation of the cleat arms, wherein by way of said connecting device, the cleat arms can be locked in an upper end position and a lower end position, and wherein are the cleat arms in the upper end position are open are arranged in the operational and in the lower end position are folded down;

characterized in that the cleat arms in the lower end position, lie on the deck or are oriented at a small distance from the deck.

* * * * *